US009527321B2

(12) United States Patent
Kawase et al.

(10) Patent No.: US 9,527,321 B2
(45) Date of Patent: Dec. 27, 2016

(54) ELECTRONIC DEVICE AND IMAGE FORMING APPARATUS

(71) Applicants: Junichi Kawase, Kanagawa (JP); Junichi Murano, Saitama (JP); Shoji Asanuma, Kanagawa (JP); Toshihiro Shimada, Tokyo (JP); Kouta Hirakawa, Tokyo (JP); Tsuyoshi Endo, Kanagawa (JP); Hiroki Ishimitsu, Kanagawa (JP); Masahiro Ishida, Kanagawa (JP); Naoki Matsuda, Kanagawa (JP)

(72) Inventors: Junichi Kawase, Kanagawa (JP); Junichi Murano, Saitama (JP); Shoji Asanuma, Kanagawa (JP); Toshihiro Shimada, Tokyo (JP); Kouta Hirakawa, Tokyo (JP); Tsuyoshi Endo, Kanagawa (JP); Hiroki Ishimitsu, Kanagawa (JP); Masahiro Ishida, Kanagawa (JP); Naoki Matsuda, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/728,045

(22) Filed: Jun. 2, 2015

(65) Prior Publication Data

US 2015/0343816 A1 Dec. 3, 2015

(30) Foreign Application Priority Data

Jun. 3, 2014 (JP) ..... 2014-115059

(51) Int. Cl.
*B41J 29/10* (2006.01)

(52) U.S. Cl.
CPC ..... *B41J 29/10* (2013.01)

(58) Field of Classification Search
CPC ..... B41J 29/10
USPC ..... 181/201, 202
See application file for complete search history.

(56) References Cited

FOREIGN PATENT DOCUMENTS

| | | |
|---|---|---|
| JP | 04-000469 | 1/1992 |
| JP | 2000-112306 | 4/2000 |
| JP | 2000-235396 | 8/2000 |

OTHER PUBLICATIONS

Translation of JP 2000-112306 A, accessed Jan. 11, 2016; <https://www4.j-platpat.inpit.go.jp/cgi-bin/tran_web_cgi_ejje?u=http://www4.j-platpat.inpit.go.jp/eng/translation/201601120531238232624350775400 5229D79F32EE18517B7-2CD38B50C5E5BCA7C>.*

* cited by examiner

*Primary Examiner* — Jeremy Luks
(74) *Attorney, Agent, or Firm* — Harness, Dickey & Pierce, P.L.C.

(57) ABSTRACT

An electronic device comprises: a shielding object that is arranged at least in a plurality of directions and shields noise; and a Helmholtz silencer that is arranged in a direction where the shielding object does not exist, the shielding object and the silencer being arranged with respect to a noise source causing noise such as a driving source that is arranged inside an apparatus body, wherein a neck portion of the Helmholtz silencer is directed to the noise source, a plurality of such Helmholtz silencers are provided to correspond to at least two kinds of frequencies, and installed number of the Helmholtz silencers corresponding to at least two kinds of the frequencies respectively, is made different depending on a distance from the noise source.

11 Claims, 8 Drawing Sheets

$$f = \frac{c}{2\pi}\sqrt{\frac{S}{V(L+\Delta r)}}$$

f: RESONANCE FREQUENCY
c: SOUND VELOCITY
Δr: OPEN END CORRECTION

ELECTRONIC DEVICE AND IMAGE FORMING APPARATUS

CROSS-REFERENCE TO RELATED APPLICATION(S)

The present application claims priority to and incorporates by reference the entire contents of Japanese Patent Application No. 2014-115059 filed in Japan on Jun. 3, 2014.

BACKGROUND OF THE INVENTION

1. Field of the Invention

The present invention relates to an electronic device including therein a Helmholtz silencer, and in more detail, to an image forming apparatus such as a copying machine, a facsimile, a printer, and a multifunction peripheral thereof.

2. Description of the Related Art

Recently, in an image forming apparatus, noise reduction and unpleasant sound reduction of machines have been demanded. In particular, such reduction is accelerating regarding a polygon motor of a writing unit that causes high-frequency unpleasant sound.

Japanese Patent Application Laid-open No. 2000-235396 discloses an invention in which a Helmholtz silencer is configured with an exterior cover so as to reduce noise of a device while saving space. However, the invention has the problem that it is difficult to design a desired distance between a noise source and a Helmholtz silencer and the problem that the costs are increased because the exterior cover is arranged on the entire side surface, for example.

That is, in the case of the conventional Helmholtz silencer attached to the exterior cover or the like, the Helmholtz silencer is separated from a writing unit (noise source), and thus the silencing effect is reduced. Furthermore, there occurs a problem of high-frequency unpleasant noise generated when a polygon motor of a writing unit rotates individually during operation.

When the Helmholtz silencer is arranged in the entire periphery of a noise source to prevent high-frequency noise from leaking to the outside in order to solve the problems, the costs are increased and the space cannot be secured.

When a target frequency is determined, the approximate size of a Helmholtz silencer is determined. Thus, when an installation position, a noise source, and a frequency are determined, a distance between the noise source and the Helmholtz silencer is determined to some degree. This causes a restriction that the noise source and the Helmholtz silencer cannot be brought closer to each other, thus reducing the silencing effect.

Moreover, in an image forming apparatus having a plurality of line velocities, a low frequency to a high frequency cause unpleasant noise, which is a problem. The inventors of the present application are not responsible for the conventional techniques for solving such a problem using a Helmholtz silencer.

Moreover, when the Helmholtz silencer is attached to an exterior cover of an image forming apparatus body, the cover opening or closing operation force is increased, causing a problem of the obstacle to the operation of inserting or taking out inner units. When the Helmholtz silencer is configured integrally with the exterior cover, the cover needs to be formed newly when used in a similar model with a slight difference.

In view of the conventional problems, there is a need to improve the arrangement of the Helmholtz silencer and the silencing effect thereof.

SUMMARY OF THE INVENTION

It is an object of the present invention to at least partially solve the problems in the conventional technology.

According to the present invention, there is provided an electronic device comprising: a shielding object that is arranged at least in a plurality of directions and shields noise; and a Helmholtz silencer that is arranged in a direction where the shielding object does not exist, the shielding object and the silencer being arranged with respect to a noise source causing noise such as a driving source that is arranged inside an apparatus body, wherein a neck portion of the Helmholtz silencer is directed to the noise source, a plurality of such Helmholtz silencers are provided to correspond to at least two kinds of frequencies, and installed number of the Helmholtz silencers corresponding to at least two kinds of the frequencies respectively, is made different depending on a distance from the noise source.

The present invention also provides an image forming apparatus comprising: a shielding object that is arranged at least in a plurality of directions and shields noise; and a Helmholtz silencer that is arranged in a direction where the shielding object does not exist, the shielding object and the silencer being arranged with respect to a noise source causing noise such as a driving source that is arranged inside an apparatus body, wherein a neck portion of the Helmholtz silencer is directed to the noise source, a plurality of such Helmholtz silencers are provided to correspond to at least two kinds of frequencies, and installed number of the Helmholtz silencers corresponding to at least two kinds of the frequencies respectively, is made different depending on a distance from the noise source.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of the present invention will be described below with reference to the enclosed drawings.

In an image forming apparatus according to the embodiments of the present invention, a Helmholtz silencer is arranged in the vicinity of a writing unit (noise source), and hole openings (neck portions) are arranged at the side of the writing unit (noise source), thereby exerting the silencing effect efficiently. When the writing unit (noise source) is arranged in a structure forming the image forming apparatus body, the Helmholtz silencer is arranged on the side of non-shielded surfaces of the writing unit. This arrangement improves the silencing effect while reducing the number of Helmholtz silencers. Moreover, a plurality of Helmholtz silencers corresponding to respective frequencies of generated noise are arranged to silence various kinds of noise from low frequency to high frequency. Furthermore, a member to which the Helmholtz silencer is attached is an interior cover of the image forming apparatus body so as to achieve downsizing, lightweight, and easiness in attaching and removing the device.

First, an image forming apparatus that is an example of an electronic device embodied in the present invention will be described with reference to FIG. 1. In the description, an image forming apparatus 1 is a monochrome copying machine. However, the present invention is not limited thereto.

Figure 1:
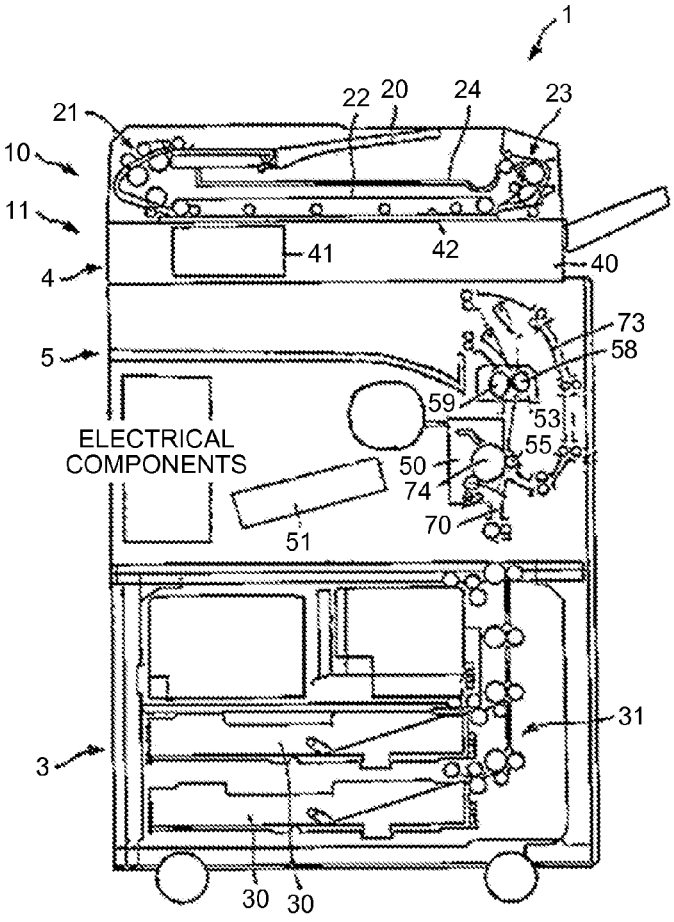
FIG. 1 is a diagram for explaining an image forming apparatus that is an example of an electronic device embodied in the present invention.

As illustrated in FIG. 1, the image forming apparatus 1 includes an automatic document feeder (hereinafter, referred to as an ADF) 10 and an image forming apparatus body 11. The image forming apparatus body 11 includes a paper feeding unit 3, an image reading unit 4, and an image forming unit 5. Note that, in this specification, the front side F of the image forming apparatus 1 indicates the near side of the image forming apparatus, while the rear side R indicates the far side of the image forming apparatus 1.

The ADF 10 includes a document tray 20, a paper feeding roller 21, a carriage belt 22, a paper ejection roller 23, and a paper ejection tray 24. The ADF 10 is attached to the image reading unit 4 through an opening and closing mechanism (not illustrated) such as a hinge so as to be opened and closed freely.

The paper feeding roller 21 separates each piece of a bundle of documents (not illustrated) placed on the document tray 20 and transfers the piece to the image reading unit 4. The carriage belt 22 transfers the document separated by the paper feeding roller 21 to the image reading unit 4. The paper ejection roller 23 ejects the document discharged from the image reading unit 4 through the carriage belt 22 to the paper ejection tray 24 on the lower side of the document tray 20.

The paper feeding unit 3 includes a paper feeding cassette 30 and a paper feeding unit 31. The paper feeding cassette 30 stores different paper sizes of recording media (not illustrated). The paper feeding unit 31 conveys the recording medium stored in the paper feeding cassette 30 to an image forming position of the image forming unit 5.

The image reading unit 4 includes a housing 40, an optical scanning unit 41, a contact glass 42, and a driving unit (not illustrated). The optical scanning unit 41 is provided inside the housing 40, and includes a light emitting diode (LED) unit. The optical scanning unit 41 emits light from the LED unit in a main-scanning direction, and the driving unit scans the whole irradiated area in a sub-scanning direction. In this way, the optical scanning unit 41 reads out a two-dimensional color image of a document.

The contact glass 42 is provided on the upper side of the housing 40 and forms an upper surface portion of the housing 40. The driving unit includes wire fixed to the optical scanning unit 41, a plurality of driven pulleys and driving pulleys that bridge the wire, and a motor that rotates the driving pulleys.

The image forming unit 5 includes an exposure unit 51, an image formation unit 50, a transfer roller 55, a fixing unit 53 as an example of a fixing device, a main conveying path 70, and a reverse conveying path 73.

As illustrated in FIG. 1, the exposure unit 51 is arranged to be adjacent to the image formation unit 50. The exposure unit 51 exposes a photoconductor drum 74. The image formation unit 50 includes, in the periphery of the photoconductor drum 74, a charging device, a developing device, a photoconductor cleaning device, a neutralizing device, and the like. Then, the photoconductor drum 74 and the above-described devices provided in the periphery of the photoconductor drum 74 are unitized to form one process cartridge.

The image formation unit 50 forms a visible image (toner image) using the photoconductor drum 74, based on image information read out by the image reading unit 4. Moreover, the visible image formed on the photoconductor drum 74 is transferred by the photoconductor drum 74 and the transfer roller 55.

Then, the transfer roller 55 is pressed against the photoconductor drum 74, whereby a toner image formed on the photoconductor drum 74 is transferred onto a recording medium conveyed from the paper feeding unit 3 through the main conveying path 70. The fixing unit 53 is provided on the downstream side, in the conveying direction of the recording medium, of the transfer roller 55. The fixing unit 53 is constituted by pressing a pressing roller 59 against a fixing roller 58. Then, the fixing unit 53 adds heat and pressure to the recording medium by the pressing roller 59 so as to melt toner of the toner image transferred to the recording medium and fix the toner image onto the recording medium as an image.

Moreover, as illustrated in FIG. 1, the reverse conveying path 73 is provided on the right side of the transfer roller 55 and the fixing unit 53. In order to form images on both surfaces of the recording medium, the reverse conveying path 73 reverses the side of the recording medium discharged from the fixing unit 53 and supplies the recording medium again to the transfer roller 55 through the main conveying path 70.

Figure 2:
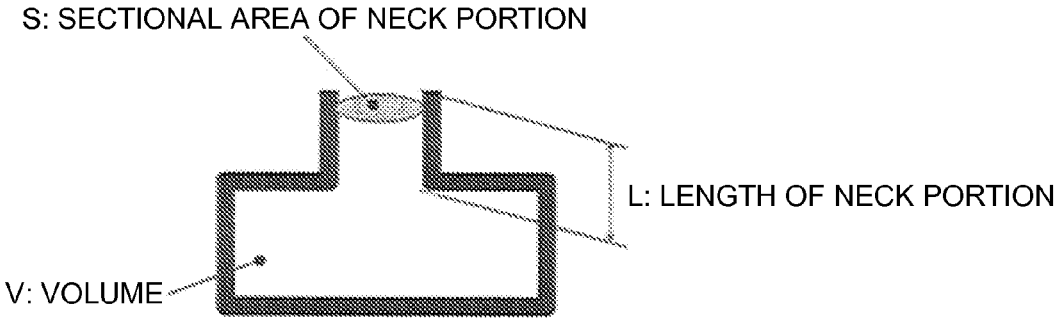
FIG. 2 is a schematic view of a Helmholtz silencer.
Figures 3, 4:
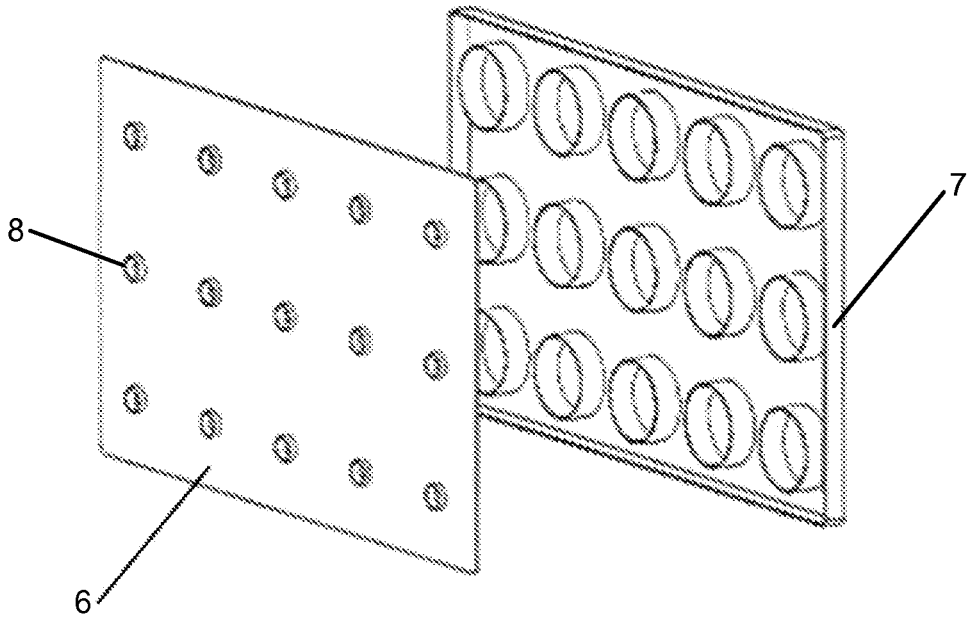
FIG. 3 is a diagram illustrating a frequency-deriving expression.
FIG. 4 is an exploded view of a conventional Helmholtz silencer.

FIG. 2 and FIG. 3 are diagrams for explaining a Helmholtz silencer. FIG. 2 is a schematic view of a Helmholtz silencer. The Helmholtz silencer, which has a form of a container with a narrowed opening and includes a resonance box and a neck portion smaller than the resonance box, silences noise of a certain frequency that enters the neck portion. The expression for deriving the frequency is illustrated in FIG. 3. Δr is an open end correction. With a radius r when the neck portion is circular in general, Δr=0.6r is used.

Figure 5:
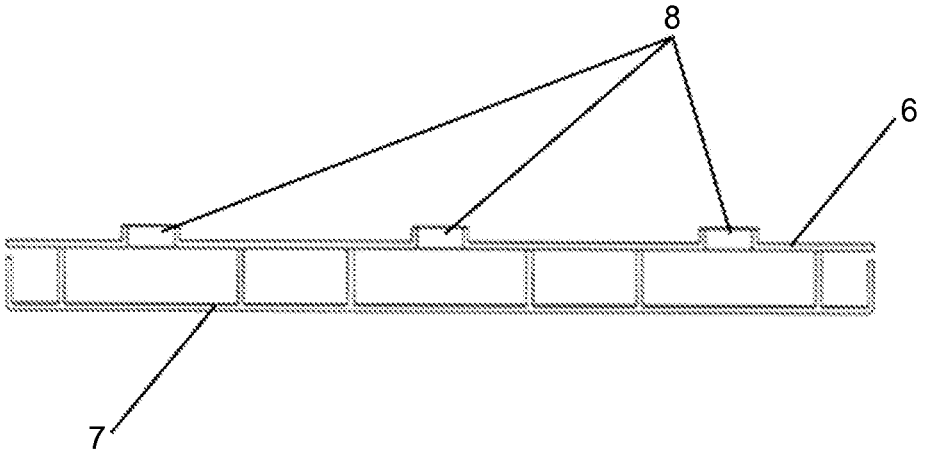
FIG. 5 is a section view of the conventional Helmholtz silencer.

FIG. 4 and FIG. 5 are diagrams for explaining the configuration of a known Helmholtz silencer. FIG. 4 is an exploded view of the known Helmholtz silencer, and FIG. 5 is a section view thereof. An outer cover 6 and an inner cover 7 form a resonance box, and openings provided on the outer cover 6 are neck portions 8. The inner cover 7 forms the body structure, or the outer cover 6 forms an exterior cover or an interior cover, whereby the increase of the number of components can be suppressed. However, the body structure includes thereon a number of components that can be vibration sources and easily receives vibration. Moreover, the positions of the body structure, the exterior cover, and the interior cover are determined, and thus a distance between the Helmholtz silencer and the noise source is determined necessarily. Therefore, when the distance therebetween is large, it is difficult to exert the silencing effect.

First Embodiment

Figure 6:
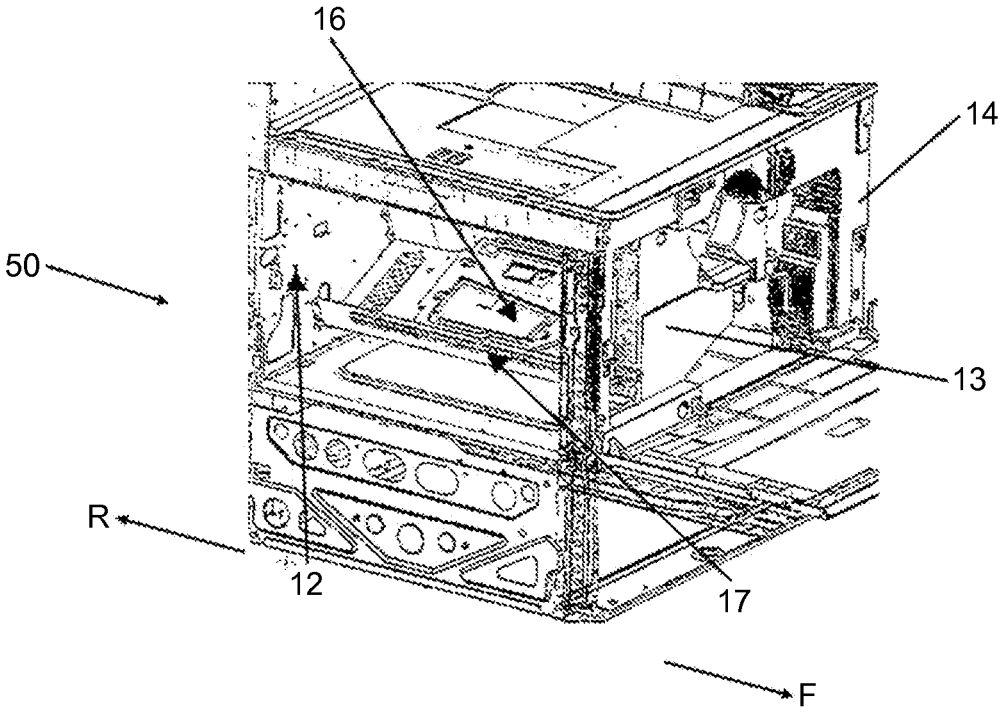
FIG. 6 is a perspective view of an image formation unit 50 including a Helmholtz silencer.
Figure 7:
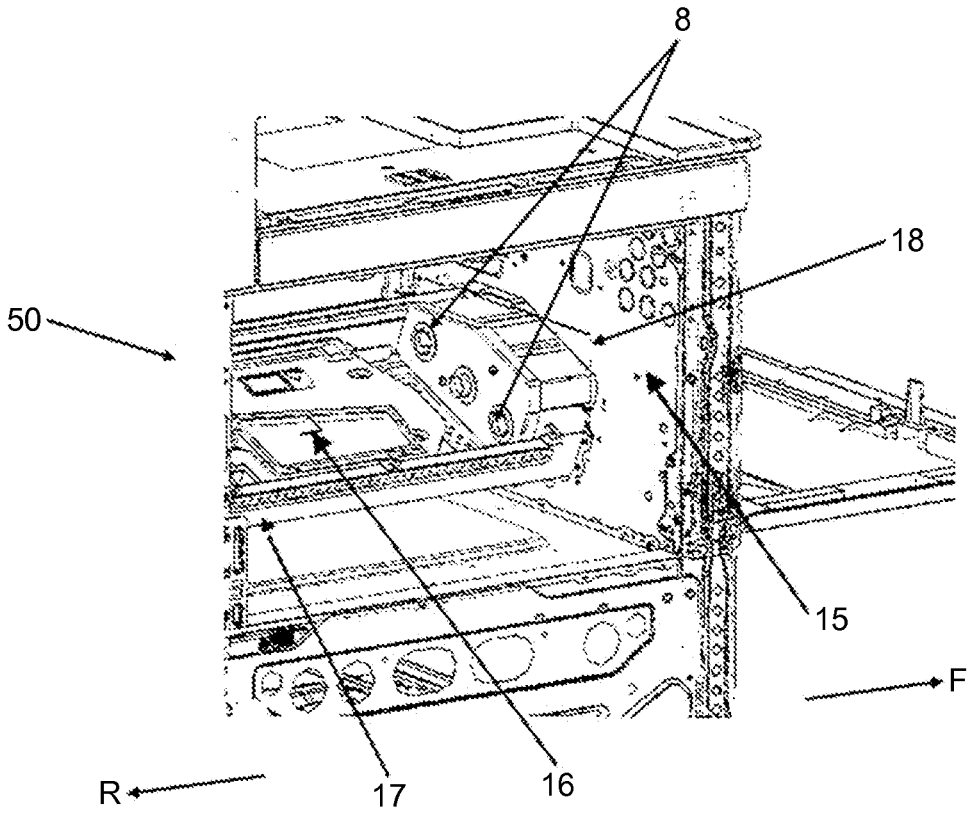
FIG. 7 is a perspective view of the image formation unit 50 including a Helmholtz silencer.
Figure 8:
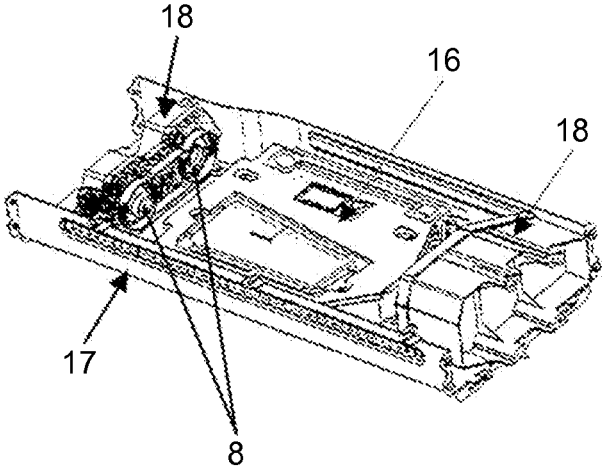
FIG. 8 is a perspective view illustrating main portions of FIG. 6 and FIG. 7.
Figure 9:
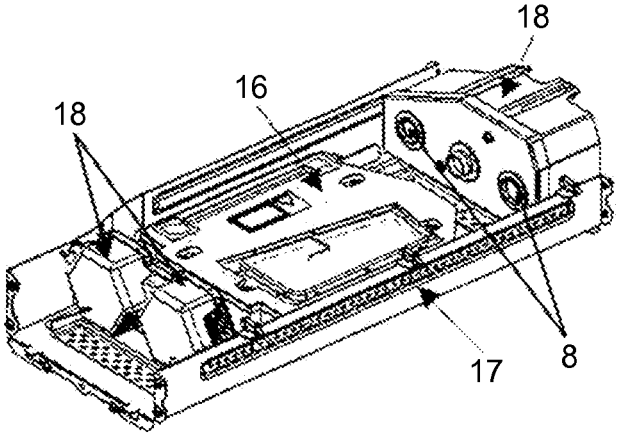
FIG. 9 is a perspective view illustrating the main portions of FIG. 6 and FIG. 7.

The configuration of a first embodiment of the present invention will be described with reference to FIG. 6 to FIG. 9. FIG. 6 and FIG. 7 are perspective views of the image formation unit 50 including a Helmholtz silencer. FIG. 8 and FIG. 9 are perspective views illustrating main portions of FIG. 6 and FIG. 7. The structure includes side boards (a rear side board 12 and a writing interior cover 13 and an interior cover 14 in FIG. 6, and a front side board 15 in FIG. 7) arranged in the front side and the rear side of the image formation unit 50. In order to fix a writing unit 16 (exposure unit 51 in the apparatus of FIG. 1), the positioning is performed through a stay (writing) 17. The writing unit 16 is mounted on the stay (writing) 17. On the side adjacent to the writing unit 16, the Helmholtz silencers 18, which has a form of a container with a narrowed opening and includes resonance boxes and neck portions 8 smaller than the resonance boxes, are arranged so as to efficiently silence noise of certain frequencies that enters the neck portions. Moreover, the writing unit 16 is mounted on the stay (writing) 17 and the bottom surface and the right and left surfaces are shielded by sheet metal members. Thus, the Helmholtz silencers 18 are arranged only the front side and rear side of the writing unit 16. FIG. 7 illustrates the neck portions 8 provided on the outer cover 6 of the Helmholtz silencer 18.

Figure 10:
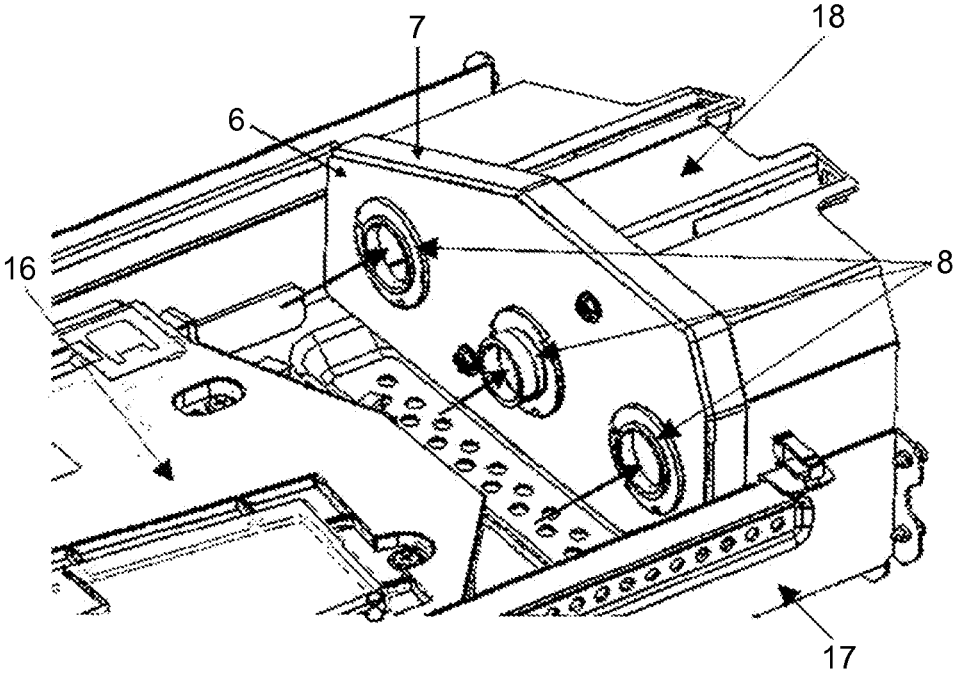
FIG. 10 is a diagram illustrating a front-side Helmholtz silencer 18 illustrated in FIG. 8 and FIG. 9, in an enlarged manner.

FIG. 10 illustrates the front-side Helmholtz silencer 18 illustrated in FIG. 8 and FIG. 9, in an enlarged manner. The writing unit 16 is mounted on the above-described frame-formed stay (writing) 17. Then, the openings (neck portions 8) of the Helmholtz silencer 18 are directed to the noise source (writing unit 16) of noise occurring when driven during operation of the image forming apparatus 1. This arrangement makes it possible to silence noise efficiently.

Figure 11:
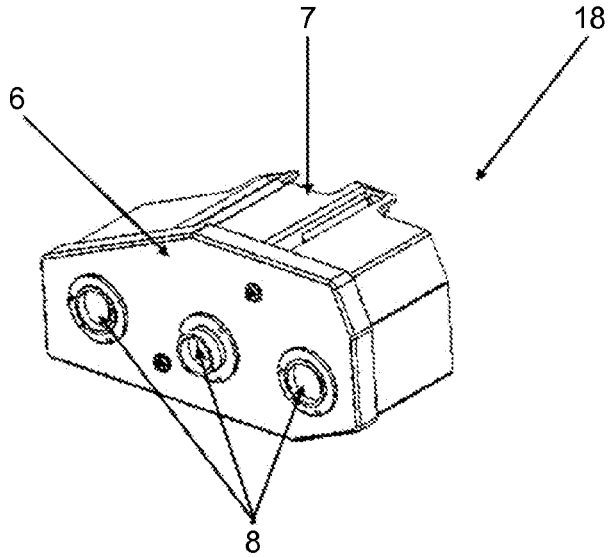
FIG. 11 is a perspective view illustrating the Helmholtz silencer 18 in an extracted manner.
Figure 12:
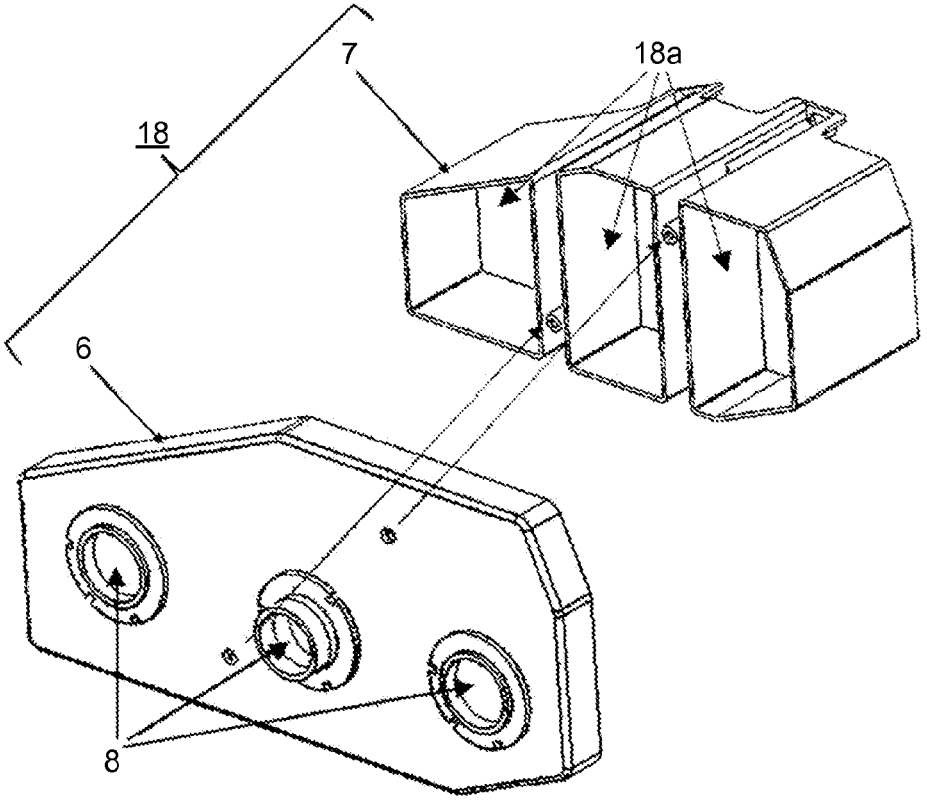
FIG. 12 is an exploded perspective view illustrating the Helmholtz silencer 18 in an extracted manner.

FIG. 11 is a perspective view illustrating the Helmholtz silencer 18 in an extracted manner, and FIG. 12 is an exploded perspective view illustrating the Helmholtz silencer 18 in an extracted manner. In the Helmholtz silencer 18 illustrated in FIG. 12, a plurality of containers 18*a* as resonance boxes each having a form of a container and the neck portions 8 smaller in diameter than the containers 18*a* form a plurality of small rooms each of which has a narrowed opening (the neck portion 8). Then, the small rooms (three rooms in FIG. 12) are arranged in parallel with each other so that each room functions as a silencer. Such containers 18*a* and openings (neck portions 8) silence noise by containing certain frequencies entering the neck portions 8 in the containers 18*a*.

Note that the forms of the small rooms are made different in and FIG. 12 and the neck portion 8 is arranged in each of the three containers 18*a* having different forms, thus silencing noise of frequencies. In the embodiment, the neck portions 8 at the left end and the right end in FIG. 11 and FIG. 12 have the same shape, so that the neck portion 8 in the center and the neck portions 8 at the right and left ends correspond to two kinds of frequencies. That is, the right and left neck portions, which are far from the noise source, are provided at two positions, respectively, and the number is larger than one center neck portion 8, thus exerting the silencing effect for two kinds of frequencies.

Second Embodiment

Figure 13:
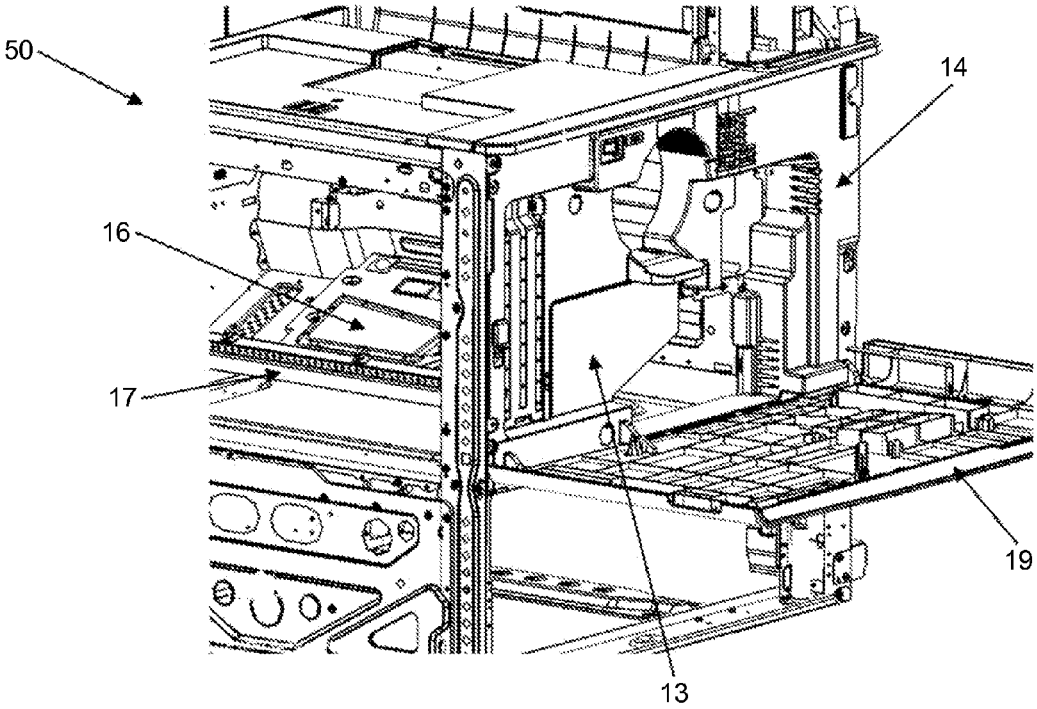
FIG. 13 is a perspective view of an image forming apparatus including a Helmholtz silencer.
Figure 14:
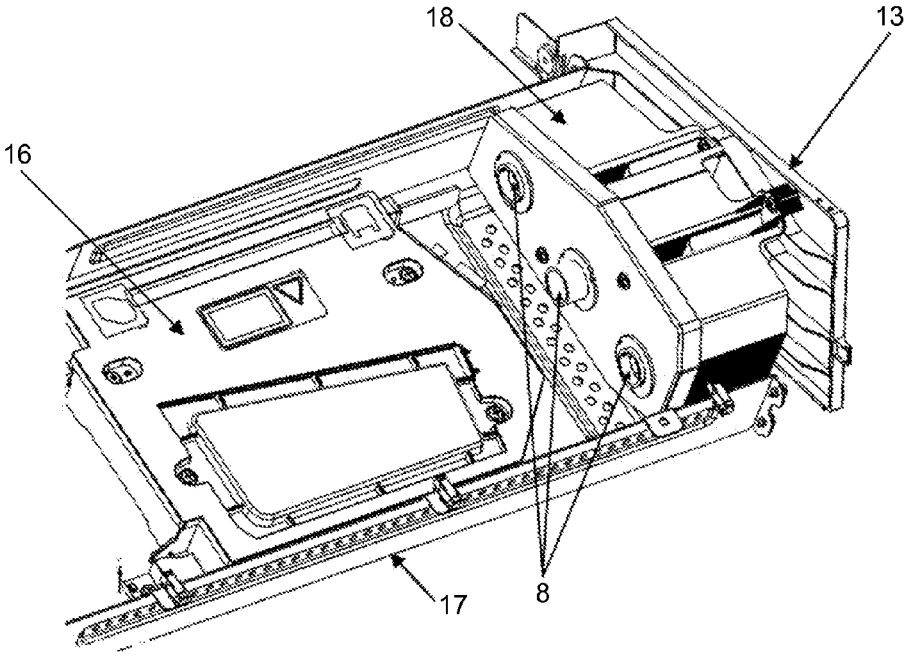
FIG. 14 is a perspective view illustrating main portions of FIG. 13.
Figure 15:
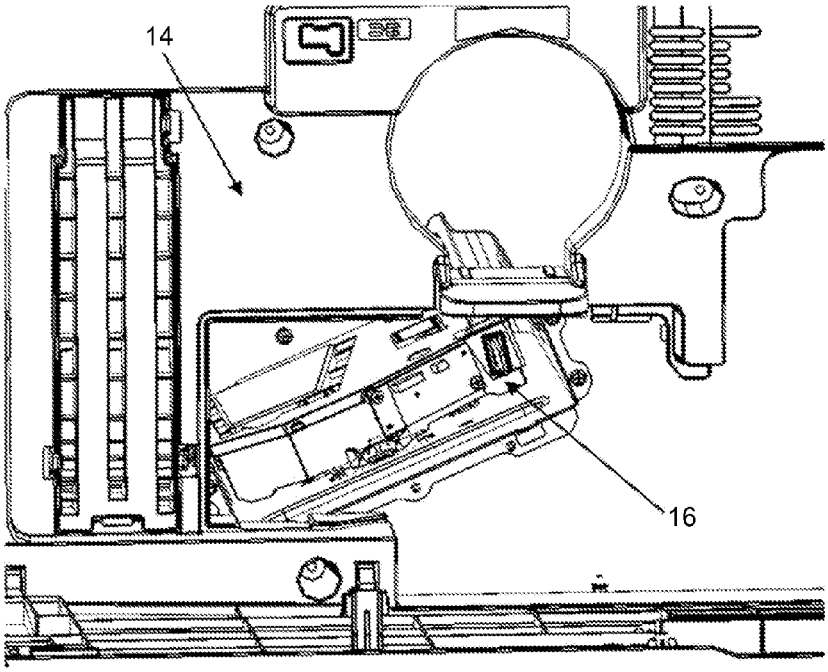
FIG. 15 is a side view illustrating the main portions of FIG. 13.
Figure 16:
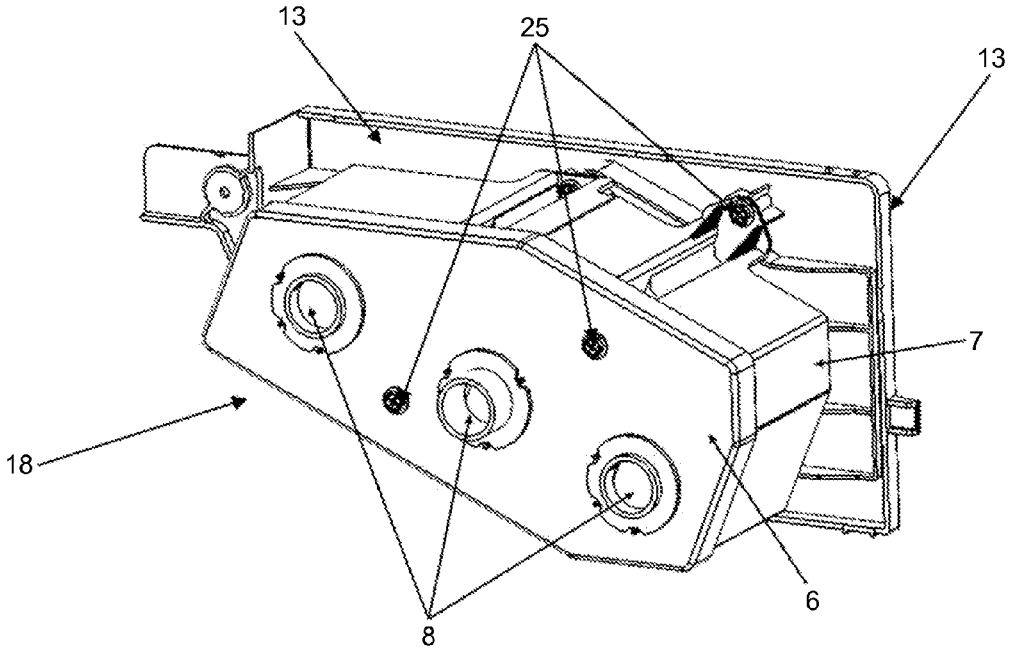
FIG. 16 is a perspective view illustrating the main portions of FIG. 13 in an enlarged manner.

The configuration of a second embodiment of the present invention will be described with reference to FIG. 13 to FIG. 16. FIG. 13 is a perspective view of an image forming apparatus including a Helmholtz silencer. FIG. 14 is a perspective view illustrating main portions of FIG. 13, FIG. 15 is a side view thereof, and FIG. 16 is a perspective view illustrating such main portions in an enlarged manner. As illustrated in FIG. 13, an interior cover covering necessary inner components such as the Helmholtz silencer 18 is provided inside a front exterior cover 19. The interior cover is divided in a plurality of parts (divided in two in FIG. 13). In the embodiment, the interior cover includes the writing interior cover 13 covering the periphery of the writing unit 16 and the interior cover 14 covering other portions. As illustrated in FIG. 15, the Helmholtz silencer 18 is provided on the inner side of the writing interior cover 13. Such a configuration allows the access to the writing unit 16 by removing only the writing interior cover 13, as illustrated in FIG. 15.

As illustrated in FIG. 16, the writing interior cover 13 and the Helmholtz silencer 18 are connected to each other by fastening members 25 such as screws. In this way, when the support for a different frequency is required, only the Helmholtz silencer can be replaced.

As described above, the bottom surface and the right surface of the writing unit 16 as a noise source are surrounded by the stay members (stay (writing) 17 and the like) having a frame form or the like. Thus, when the Helmholtz silencer 18, which has a form of a container with a narrowed opening and includes resonance boxes and neck portions smaller than the resonance boxes, is arranged on the sides of the non-shielded front surface and rear surface, the silencing effect can be exerted more easily. When the number of non-shielded surfaces is reduced, the number of Helmholtz silencer 18 is reduced, thus reducing costs. Furthermore, when the Helmholtz silencer 18 is arranged on the operator position, the degree of discomfort at the operator position can be reduced.

Moreover, when the openings (neck portions 8) of the Helmholtz silencer 18 are directed to the writing unit 16 as a noise source, the silencing effect can be exerted more easily, and noise leak can be reduced.

When a plurality of large and small containers of various kinds of Helmholtz silencers 18 are arranged, it is possible to exert the silencing effect on noise more easily in a wider range from low frequency to high frequency. Moreover, the number of containers corresponding to frequencies is changed depending on a distance from a noise source, whereby the same silencing effect can be obtained regarding various frequencies.

When a member to which the Helmholtz silencer 18 is attached is the writing interior cover 13 and the interior cover 14 that cover necessary inner components while the exterior cover is open, a separate member for attachment is not needed, and thus the structure is simplified. Moreover, it is possible to avoid increase of opening and closing operation force of the exterior cover (front exterior cover 19) and prevent the obstacle to the operation of inserting and taking out inner units. When the interior cover is divided into a plurality of parts and each part of the interior cover can be attached and removed individually, the Helmholtz silencer 18 is attached to the interior cover that covers only the periphery of the writing unit 16, for example. In this way, when the access to the writing unit 16 is required for maintenance operation and the like, the access is possible simply by removing and attaching the interior cover of this portion, and thus service workability is improved.

Furthermore, if the Helmholtz silencer 18 is attached to the interior cover with the removable fastening members 25 such as screws, use of the Helmholtz silencer 18 of a similar model with a slight difference, for example, a different generating frequency, such as of a polygon motor or the like is enabled simply by replacing the Helmholtz silencer 18 to one to which tuning was performed in accordance with the model, and thus increase of the number of components and costs can be prevented.

The present invention is not limited to the above-described embodiments, and many modifications can be made by a person skilled in the art within the technical idea of the present invention.

According to the embodiments of the present invention, the Helmholtz silencer is arranged in a direction where shielding objects for shielding a noise source are not arranged. Thus, it is easier to exert the silencing effect. Moreover, the number of non-shielded surfaces is reduced, whereby Helmholtz silencers can be reduced in number, and the costs can be reduced. Furthermore, when each of the Helmholtz silencers is arranged on a target position side such as an operator position, for example, the degree of discomfort at the target position such as the operator position can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electronic device, comprising:

a body of the device;

a noise source placed in the body; and at least three Helmholtz silencers, each including a container with an opening; wherein the at least three Helmholtz silencers are configured to deal with at least two kinds of frequencies, respective distances between the noise source and respective ones of the at least three Helmholtz silencers are varied in accordance with respective ones of the at least two kinds of frequencies to be dealt with by the respective ones of the at least three Helmholtz silencers, and a number of the at least three Helmholtz silencers relatively far from the noise source are larger than a number of the at least three Helmholtz silencers dealing with frequencies other than the frequencies dealt with by the number of the at least three Helmholtz silencers relatively far from the noise source.

2. The electronic device of claim 1, wherein a number of the at least three Helmholtz silencers is varied in accordance with a number of the at least two frequencies to be dealt with by the respective ones of the at least three Helmholtz silencers.

3. The electronic device of claim 2, wherein an area of opening of each of the at least three Helmholtz silencers is the same.

4. The electronic device of claim 1, further comprising a writing unit including the noise source, the noise source being a polygon motor of the writing unit, wherein the body of the writing unit includes surfaces shielding a plurality of sides of the polygon motor, and wherein the Helmholtz silencers are placed on surfaces of the body of the writing unit at locations not shielded by the body of the writing unit.

5. An image forming apparatus, comprising:

a writing unit;

a photoconductor;

a body of the apparatus;

a noise source placed in the body; and a plurality of Helmholtz silencers, each including a container with an opening; wherein the plurality of Helmholtz silencers are configured to deal with at least two kinds of frequencies, and respective distances between the noise source and respective ones of the plurality of Helmholtz silencers are varied in accordance with respective ones of the at least two frequencies to be dealt with by the respective ones of the plurality of Helmholtz silencers, the noise source is a polygon motor of the writing unit, and the plurality of Helmholtz silencers are respectively placed at locations indicated by a direction perpendicular to a direction of output of the writing unit when exposing light to the photoconductor.

6. The image forming apparatus of claim 5, wherein a number of the plurality of Helmholtz silencers is varied in accordance with a number of the at least two frequencies to be dealt with by the respective ones of the plurality of Helmholtz silencers.

7. The image forming apparatus of claim 6, wherein the number of the Helmholtz silencers is at least three.

8. The image forming apparatus of claim 7, wherein an area of opening of each of the plurality of Helmholtz silencers is the same.

9. The image forming apparatus of claim 8, wherein a member, to which the plurality of Helmholtz silencers are attached, is an interior cover to cover inner components, while an exterior cover constituting the body of the apparatus is open, and the interior cover is configured to be divided into at least two parts, each of the at least two parts of the interior cover be attachable to and removable from the body of the apparatus.

10. The image forming apparatus of claim 5, wherein the body of the writing unit includes surfaces shielding a plurality of sides of the polygon motor, and the Helmholtz silencers are placed on surfaces of the body of the writing unit at locations not shielded by the body of the writing unit.

11. A writing unit comprising:

a body of the writing unit;

a noise source placed in the body; and a plurality of Helmholtz silencers, each including a container with an opening; wherein the plurality of Helmholtz silencers are configured to deal with at least two kinds of frequencies, and respective distances between the noise source and respective ones of the plurality of Helmholtz silencers are varied in accordance with respective ones of the at least two frequencies to be dealt with by the respective ones of the plurality of Helmholtz silencers, the noise source is a polygon motor of the writing unit, the body of the writing unit includes surfaces shielding a plurality of sides of the polygon motor, and the Helmholtz silencers are placed on surfaces of the body of the writing unit at locations not shielded by the body of the writing unit.

* * * * *